US011292707B2

(12) United States Patent
Lecomte et al.

(10) Patent No.: US 11,292,707 B2
(45) Date of Patent: Apr. 5, 2022

(54) POST-MIXING BEVERAGE DISPENSER HAVING PRESSURIZABLE INGREDIENT CONTAINERS

(71) Applicant: KUANTOM, Paris (FR)

(72) Inventors: Valentin Lecomte, Mennecy (FR); Geoffrey Martins, Cormeilles-en-Parisis (FR)

(73) Assignee: KUANTOM, Paris (FR)

( * ) Notice: Subject to any disclaimer, the term of this patent is extended or adjusted under 35 U.S.C. 154(b) by 0 days.

(21) Appl. No.: 16/979,050

(22) PCT Filed: Mar. 1, 2019

(86) PCT No.: PCT/EP2019/055176
§ 371 (c)(1),
(2) Date: Nov. 10, 2020

(87) PCT Pub. No.: WO2019/170548
PCT Pub. Date: Sep. 12, 2019

(65) Prior Publication Data

US 2021/0094812 A1 Apr. 1, 2021

(30) Foreign Application Priority Data

Mar. 5, 2018 (FR) ..... 1851866

(51) Int. Cl.
*B67D 1/00* (2006.01)
*B67D 1/04* (2006.01)
(Continued)

(52) U.S. Cl.
CPC ..... *B67D 1/0036* (2013.01); *B67D 1/0047* (2013.01); *B67D 1/0078* (2013.01);
(Continued)

(58) Field of Classification Search
CPC .. B67D 1/0036; B67D 1/0047; B67D 1/0078; B67D 1/0085; B67D 1/0431;
(Continued)

(56) References Cited

U.S. PATENT DOCUMENTS 4,928,853 A * 5/1990 Isham ..... B67D 1/0041 222/108
5,251,790 A * 10/1993 Cohn ..... A47F 9/00 222/146.6

(Continued)

FOREIGN PATENT DOCUMENTS

WO 2012128477 A2 9/2012
WO 2016201305 A1 12/2016
WO 2017144477 A1 8/2017

OTHER PUBLICATIONS

International Search Report corresponding to International Application No. PCT/EP2019/055176 dated Apr. 16, 2019, 5 pages.

*Primary Examiner* — Vishal Pancholi
*Assistant Examiner* — Bob Zadeh
(74) *Attorney, Agent, or Firm* — Cooper Legal Group, LLC; Ronald M. Kachmarik

(57) ABSTRACT

An appliance for making a drink individually. The appliance includes a plurality of containers. Each container includes a vessel and a head screwed onto the vessel. A base defines a plurality of housings each receiving a container, and being provided with a housing outlet and a pressurizing inlet connected with a drain valve and a pressurizing valve of the container, respectively. A funnel is mounted under the housing outlets. Structure transfers by pressurization, into the funnel, ingredients contained in the containers housed in the housings. The vessel and the head of at least one container include polarizing surfaces of the vessel and of the head, respectively, configured to form, together, a container polarizing surface that can cooperate with a housing polarizing
(Continued)

surface to ensure a predetermined positioning of the container with respect to the housing.

17 Claims, 4 Drawing Sheets

(51) Int. Cl.
*B67D 1/08* (2006.01)
*B67D 3/00* (2006.01)
*B67D 3/04* (2006.01)

(52) U.S. Cl.
CPC ..... *B67D 1/0085* (2013.01); *B67D 1/0431* (2013.01); *B67D 1/0804* (2013.01); *B67D 1/0807* (2013.01); *B67D 1/0888* (2013.01); *B67D 1/0891* (2013.01); *B67D 3/0083* (2013.01); *B67D 3/043* (2013.01); *B67D 2001/0091* (2013.01); *B67D 2001/0098* (2013.01); *B67D 2001/082* (2013.01); *B67D 2001/0811* (2013.01)

(58) Field of Classification Search
CPC .. B67D 1/0804; B67D 1/0807; B67D 1/0888; B67D 1/0891; B67D 3/0083; B67D 3/043; B67D 2001/0091; B67D 2001/0098; B67D 2001/0811; B67D 2001/082; B67D 3/0045; B67D 1/0437; B67D 1/0801; B67D 1/0892
See application file for complete search history.

(56) References Cited

U.S. PATENT DOCUMENTS

| | | | | |
|---|---|---|---|---|
| 10,689,240 | B1 * | 6/2020 | Schultz | B67D 1/0041 |
| 10,889,482 | B1 * | 1/2021 | Maclean | A47J 31/521 |
| 2002/0083842 | A1 * | 7/2002 | Kown | C02F 1/46104 99/290 |
| 2006/0118581 | A1 * | 6/2006 | Clark | B01F 13/1066 222/333 |
| 2009/0308488 | A1 * | 12/2009 | Bennett | B67D 1/0034 141/18 |
| 2010/0058931 | A1 * | 3/2010 | Righetti | G07F 13/065 99/286 |
| 2012/0111887 | A1 * | 5/2012 | Smeller | A47J 31/402 222/129.1 |
| 2016/0039653 | A1 * | 2/2016 | Jangbarwala | B67D 1/0031 222/1 |
| 2017/0203946 | A1 * | 7/2017 | Henriquez | B67D 1/0004 |
| 2019/0053658 | A1 * | 2/2019 | Lecomte | A47J 31/41 |

* cited by examiner

POST-MIXING BEVERAGE DISPENSER HAVING PRESSURIZABLE INGREDIENT CONTAINERS

TECHNICAL FIELD

The invention relates to an appliance for making a drink individually, and in particular for making cocktails.

STATE OF THE ART

Appliances for making cocktails are available on the market. They make it possible to mix ingredients contained in different removable containers in order to create a cocktail.

Such appliances are notably described in WO12/128477.

There is a need for a novel appliance for making a drink individually, and in particular a cocktail, which is more robust, more compact, more practical to use and less expensive to make than the known appliances.

One aim of the invention is to at least partially address this need.

SUMMARY OF THE INVENTION

The invention proposes an appliance for making a drink individually, said appliance comprising:

- a base comprising a storage rack defining a plurality of housings, each housing being configured to receive a respective removable container containing an ingredient of said drink, and being provided with a housing outlet;
- a funnel removably mounted on the base, under the housing outlets, and comprising an outlet orifice, preferably a single outlet orifice;
- means for transferring into the funnel, through the housing outlets of said housings, ingredients contained in the containers housed in said housings;
- a shutter that is movable between a closed position and an open position in which it, respectively, tightly closes and leaves at least partially free, the outlet orifice of the funnel;
- an actuator mechanically coupled to the shutter to displace it between said open and closed positions;
- a control module capable of controlling, according to a desired composition for said drink, the transfer means, the drive motor and the actuator.

According to a first main aspect of the invention, the appliance also comprises:

- an emulsifier comprising an emulsifying shaft of axis X comprising a bottom end disposed inside the funnel and a top end;
- a motor driving the emulsifying shaft in rotation about the axis X, comprising a drive shaft mechanically coupled to the top end of the emulsifier shaft;

the emulsifier shaft being mounted to be movable in translation along its axis so as to form the shutter.

Advantageously, the compactness of the appliance is thereby considerably enhanced.

In a preferred embodiment, the emulsifier shaft bears a bearing of axis X in which, in the closed position only, the bottom end of the emulsifier shaft is guided in rotation. The guiding function exerted by the bearing is therefore deactivated in the open position. Advantageously, the hold of the bottom end of the emulsifier shaft enhances the robustness of the appliance.

In the closed position, the emulsifier shaft can close the outlet orifice directly, or indirectly, notably via the bearing.

Preferably, in the open position, the bearing, secured to the emulsifier shaft, can be displaced, relative to the emulsifier shaft, only by rotation about the axis X of the emulsifier shaft. Preferably, in the open position, the bearing is driven in rotation by the emulsifier shaft.

In the preferred embodiment, the internal surface of the funnel has no irregularities likely to hamper the flow through the outlet orifice.

In the closed position, the bearing is preferably held immobile with respect to the funnel, by tightening against the funnel. Preferably, this tightening results from the switching of the emulsifier shaft from the open position to the closed position.

Preferably, the bottom end of the emulsifier shaft bears a closing plug, preferably made of an elastomer material, designed to, in the closed position, enter into the outlet orifice of the funnel to a depth greater than 1 mm, preferably greater than 2 mm, 3 mm, 4 mm, 5 mm or 6 mm.

Advantageously, the closing plug thus helps hold the emulsifier shaft in position, which is particularly useful when the funnel is disassembled from the base and/or when the cover of the funnel is removed and the emulsifier shaft has to be positioned to be able to close the cover of the funnel.

Preferably, the bottom end of the emulsifier shaft bears fins, extending preferably substantially radially with respect to the axis X of the emulsifier shaft, preferably borne by the closing plug, designed to limit, in the open position, the formation of eddies in the flow, through the outlet orifice of the funnel, of a mixture of ingredients contained in the funnel.

Preferably, the fins are designed to be housed, in the closed position, at least partially in the outlet orifice of the funnel, preferably to a depth greater than 1 mm, 2 mm, 3 mm, 4 mm, 5 mm or 6 mm.

Also preferably, the fins are designed so as to oppose their introduction into the outlet orifice. In other words, introduction by force is required for this purpose. Advantageously, the holding of the emulsifier shaft in position in the closed position is reinforced.

Preferably, the bearing comprises an external ring of a rolling bearing whose internal ring is rigidly fixed onto the emulsifier shaft. Advantageously, the hold, by the bearing, of the bottom end of the emulsifier shaft, does not substantially increase the energy necessary to the rotation of the emulsifier shaft.

Still preferably, the external ring of said rolling bearing is compressed elastically by a skirt defined by the closing plug in which said external ring is inserted. Advantageously, the skirt protects the rolling bearing. Moreover, it allows for a very simple fixing of the external ring.

In an embodiment in which the bearing, in particular the external ring of the rolling bearing, is held by a skirt of the closing plug, the friction of the closing plug on the funnel and the friction of the skirt on the bearing, in particular the external ring, are adapted to, in the closed position, immobilize the bearing, in particular the external ring, with respect to the funnel.

The actuator preferably comprises:

- a support on which the drive motor of the emulsifier shaft is fixed, said support being mounted to slide on the base, preferably parallel to the axis X of the emulsifier shaft, and defining a cam path that is inclined with respect to said axis X, that is to say neither parallel nor at right angles to said axis;

an actuator motor, rigidly fixed to the base, comprising an actuator shaft mechanically coupled to a cam follower that is supported to slip on the cam path so that a slip of the cam follower on the cam path causes said support to slide in a first direction, preferably upward.

According to a second main aspect of the invention, the emulsifier shaft is coupled in translation, along the axis of the emulsifier shaft, with the shaft of the drive motor by means of an attachment, preferably magnetic, that can be deactivated by a pull on the emulsifier shaft along its axis.

As will be seen in more detail hereinafter in the description, the emulsifier shaft can thus be dismantled, which facilitates the cleaning thereof.

Preferably, the funnel comprises a bowl and a cover for closing the bowl that is passed through by an opening, the top end of the emulsifier shaft being housed, at least partially, in the opening regardless of the position of the emulsifier shaft between the closed position and the open position, the opening being designed to limit the displacement of the emulsifier shaft at right angles to its axis. In a preferred embodiment, the opening has a form that substantially complements the form of the top end of the emulsifier shaft, preferably a circular form.

Also preferably, the top end of the emulsifier shaft comprises a cylindrical skirt housed in said opening, regardless of the position of the emulsifier shaft between the closed position and the open position.

Advantageously, the emulsifier shaft can thus be held in position in the funnel when the latter is dismantled from the base.

Preferably, the top end of the emulsifier shaft is coupled in rotation, about the axis of the emulsifier shaft, with the drive shaft, by means of a claw. Advantageously, the rotational coupling between the emulsifier shaft and the drive shaft is efficient and does not require angular prepositioning.

According to a third main aspect of the invention, the funnel comprises, as described above, a bowl and a cover closing the bowl, and the cover is removably fixed to the bowl, preferably by the insertion of lugs of the cover into corresponding grooves of the bowl. When the funnel is disassembled from the base (disassembled position), the bowl and the cover advantageously isolate, from the outside, the mixture of ingredients which could remain contained in the funnel. Advantageously, the risk of dispersing of this mixture by clumsiness is limited thereby.

In a preferred embodiment, the emulsifier shaft is held inside the bowl by cooperation of its top end with an opening formed in the cover, as described previously, and by cooperation of the bottom end of the emulsifier shaft with the outlet orifice of the funnel. In one embodiment, in the disassembled position of the funnel, the emulsifier shaft tightly closes the outlet orifice of the funnel, the maintaining of this closing being, in one embodiment, obtained solely under the effect of gravity.

Preferably, the cover defines pillars which, in an assembled position of the funnel, are each inserted into a housing outlet of a respective housing, and fluidically connected with the interior of a container housed in said housing, through a drain valve of said container. Each pillar thus allows the introduction into the bowl of an ingredient leaving through the corresponding housing outlet.

Advantageously, the ingredient leaving the container is directly in contact with the funnel, which ensures optimal conditions of hygiene. Furthermore, the insertion of the pillars into the housing outlets prevents any rotation, about the axis of the funnel, of the cover with respect to the base.

Also preferably, the whole formed by the bowl and the cover is removably fixed to the base, preferably by means of at least one magnet, preferably fixed to the cover, and at least one respective metal insert, preferably fixed to the base.

Preferably, the cover comprises several magnets and the base comprises several respective metal inserts, the magnets and the inserts being positioned to be fixed to one another in one or more predetermined angular positions of the funnel with respect to the base, about the axis of the funnel.

Advantageously, the magnets and the metal inserts thus facilitate the positioning of the funnel when it needs to be assembled with the base.

Still preferably, the funnel, preferably the bowl, comprises a runner, preferably defined by a peripheral protuberance, and the base comprising a rail, extending preferably parallel to the axis of said pillars, designed to guide, by cooperation with the runner, the insertion of the pillars in the respective housing outlets.

Advantageously, the rail also prevents a rotation of the bowl with respect to the base in the assembled position of the funnel on the base. Only a pull on the funnel, parallel to the axis of the pillars, against the pull of the magnets on the metal inserts, thus makes it possible to disassemble the funnel from the base. Notably, no rotation of the funnel, and in particular no moment exerted on the bowl about the axis of the funnel, makes it possible to disassemble the funnel from the base. The risk of mishandling by the user is reduced thereby.

Preferably, the peripheral protuberances used as runners also define the grooves receiving the lugs of the cover.

According to a fourth main aspect of the invention, the appliance comprises an electronic circuit board and, for each housing, an antenna suitable for contactlessly reading a tag of a container disposed in said housing, said antenna being fixed onto a substrate linked to the electronic circuit board by a hinge, preferably a flexible film.

Advantageously, the position of the substrate with respect to the general plane of the electronic circuit board can thus be easily modified, which facilitates the assembly on the base.

Preferably, the substrate extends in a general plane forming, with the general plane of the electronic circuit board, an angle greater than 45°, 60°, 80° and/or less than 120°, 110°, 100°, preferably substantially at right angles to the general plane of the electronic circuit board.

In the preferred embodiment, the electronic circuit board extends substantially at right angles to the axis of the emulsifier shaft and the substrates of the antennas extend substantially parallel to this axis.

Also preferably, the main electronic circuit board is disposed, preferably substantially horizontally, within the volume extending between the housings, preferably above and facing the drive motor of the emulsifier shaft, and, also preferably, the substrates of the antennas extend substantially vertically, preferably bearing on said housings. The substantially vertical disposition of the antennas considerably enhances the compactness of the appliance.

Preferably, the means for transferring an ingredient out of a container disposed in a housing comprise a pressurizing pump whose outlet is fluidically connected with the interior of said container.

The starting up of the pressurizing pump, controlled by the control module, advantageously makes it possible to increase the pressure inside the container and to push the ingredient contained in this container through the outlet orifice of the housing, into the funnel.

According to a fifth main aspect, the making appliance comprises a plurality of containers, at least one, preferably each container comprising a vessel containing an ingredient of said drink, and a fixed head, preferably screwed removably onto said vessel, said container being housed in a respective housing of the storage rack, the head of said container comprising a pressurizing valve and a drain valve respectively connected with a pressurizing inlet and a housing outlet of the housing;

the vessel and the head of said container comprising polarizing surfaces of the vessel and head, respectively, configured to form, together, in a predetermined position of fixing of the head onto the vessel, preferably in a position of maximum screwing of the head onto the vessel, a container polarizing surface that can cooperate with a housing polarizer surface to ensure a predetermined positioning of the container with respect to the housing.

Advantageously, the pressurizing and drain valves can thus be easily coupled to an outlet of the pressurizing pump and to an outlet of the housing, respectively. They can then allow an intake of air from the pressurizing pump, into the vessel, and allow the ingredient to leave under the effect of this intake of air.

The container polarizing surface is configured to, in cooperation with the head polarizing surface, lock the head in position on the vessel.

Preferably, the container and housing polarizing surfaces extend, preferably vertically, against one another, preferably in contact with one another or away from one another by a distance less than 3 mm, than 2 mm, or than 1 mm, in an inserted position of the container in said housing.

Preferably, the vessel and head polarizing surfaces are aligned surfaces, preferably flat, which, together, define a polarizing surface of the container that is flat.

The polarizing surface of the housing is also, preferably, a flat surface, preferably vertical, against which each of said flat surfaces of the vessel and of the head extends, at least partially, when the container is housed in the housing (inserted position). Advantageously, the displacement of the container is then possible only parallel to the polarizing surface of the housing. The head is also advantageously locked on the vessel.

In a preferred embodiment, the head has, externally, a generally cylindrical surface of circular section, locally broken by a flat forming said head polarizing surface. Preferably, the vessel has, externally, a generally cylindrical surface of circular section, locally broken by a flat forming said vessel polarizing surface.

Preferably, the container, preferably the vessel, is provided with a suitable tag for remote electromagnetic communication, preferably an NFC tag, fixed onto the head of said container. Preferably, the tag extends over one of said polarizing surfaces of the vessel and of the head.

The head can be non-removably mounted on the vessel. In particular, it can be clipped, in tamperproof fashion, which is very suitable when the container is a consumable.

Notably in this embodiment, the head is preferably designed to be mounted on the head by sliding then, preferably clipping, preferably irreversible clipping, the sliding being preferably in a direction substantially parallel to the axis of the head.

In particular, the head can be configured to, upon its assembly on the vessel, be guided by sliding on the vessel, preferably to an extreme position in which it comes to be clipped onto the vessel, preferably definitively. The head can comprise a runner, for example a pin, configured to cooperate with a rail formed on the vessel. In an equivalent manner, the runner can be on the vessel and the rail on the vessel. The rail, preferably rectilinear, extends preferably parallel to the axis of the vessel or of the head, depending on whether it is formed on the vessel or on the head, respectively.

Advantageously, such a mounting, by sliding then clipping, is rapid and allows for a predetermined positioning of the head on the vessel, and in particular a predetermined angular positioning around the axis of the head.

In a preferred embodiment, the head and vessel polarizing surfaces are configured so that the container can be housed in a respective housing, so as to couple the pressurizing valve with the pressurizing inlet of the housing, on the one hand, and the drain valve with the housing outlet of the housing, only when said polarizing surfaces are disposed in a predefined position.

Each housing is, preferably, of a form substantially complementing the part of the container which is housed therein.

Also preferably, the head comprises a lateral wall, of generally cylindrical form, provided with an internal thread for fixing to an external thread of a neck of the vessel.

Obviously, the features, possibly optional, of the different main embodiments can be combined.

Definitions

A "valve" is sometimes also called "non-return valve". Unless indicated otherwise, the valves of an appliance according to the invention are preferably of "cross-slit" type, preferably of "umbrella valve" type.

The "upstream" and "downstream" positions are defined with respect to the flow of the ingredient.

The appliance according to the invention is described with reference to a service position in which the appliance is disposed on a horizontal level and ready to make a drink, the containers being disposed in their respective housings. The adjectives "top" and "bottom", "vertical" and "horizontal" or the adverbs "above" and "below" refer to that position.

BRIEF DESCRIPTION OF THE FIGURES

Other features and advantages of the invention will also emerge on reading the following detailed description, and on studying the attached drawing, in which.

DETAILED DESCRIPTION

General

Figure 1B:
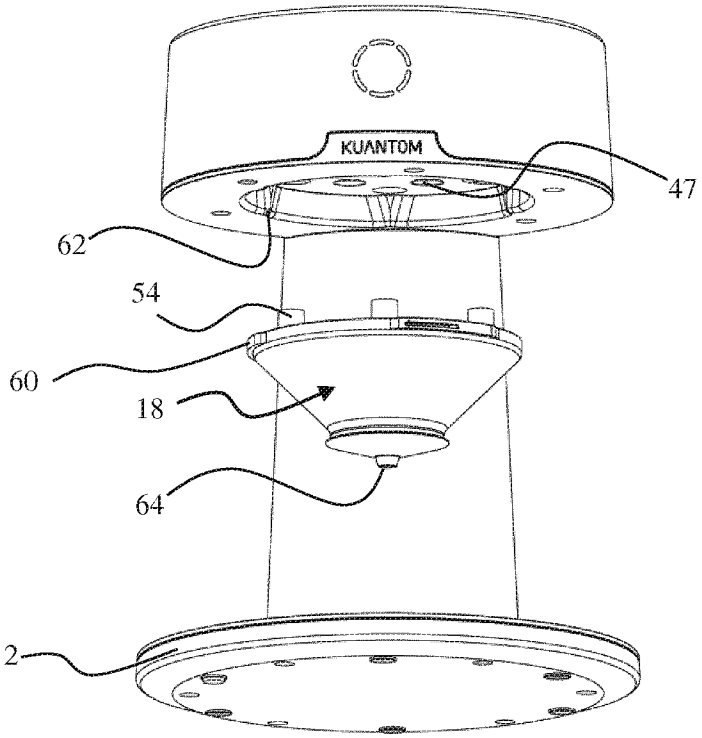
FIG. 1 (1*a* and 1*b*) represents, in perspective, an appliance according to the invention, the funnel on FIG. 1*b* being represented disassembled from the base.

FIG. 1 represents an appliance for making a drink individually, that is to say by the glass, according to the invention.

The appliance comprises a base 1 comprising a platform 2 for receiving a glass to be filled, a mast 4 fixed to the platform 2 and a storage rack 8, fixed onto the mast 4 above the platform 2 and having a plurality of housings 14. Each housing 14 is adapted to receive a container 16 containing an ingredient.

Preferably, the appliance comprises more than three, more than four, more than five, even more than six or more than seven, and/or fewer than twenty, fewer than fifteen, even fewer than ten housings, preferably fewer than eight housings, preferably six housings.

A funnel 18 is removably fixed onto the storage rack 8 and receives the ingredients leaving the containers.

The base also supports a control module 20 and pumps 22 intended to pressurize the containers.

Containers

All the containers are preferably identical. They can contain identical or different ingredients. Preferably, at least two containers contain different ingredients.

The containers 16 are removable, that is to say that they can be taken from the housings, then replaced in the housings, in the service position, as often as required.

Each housing 14 is preferably of a form substantially complementing the part of the container which is housed therein, so as to be able to receive and immobilize said container in position.

Figure 2B:
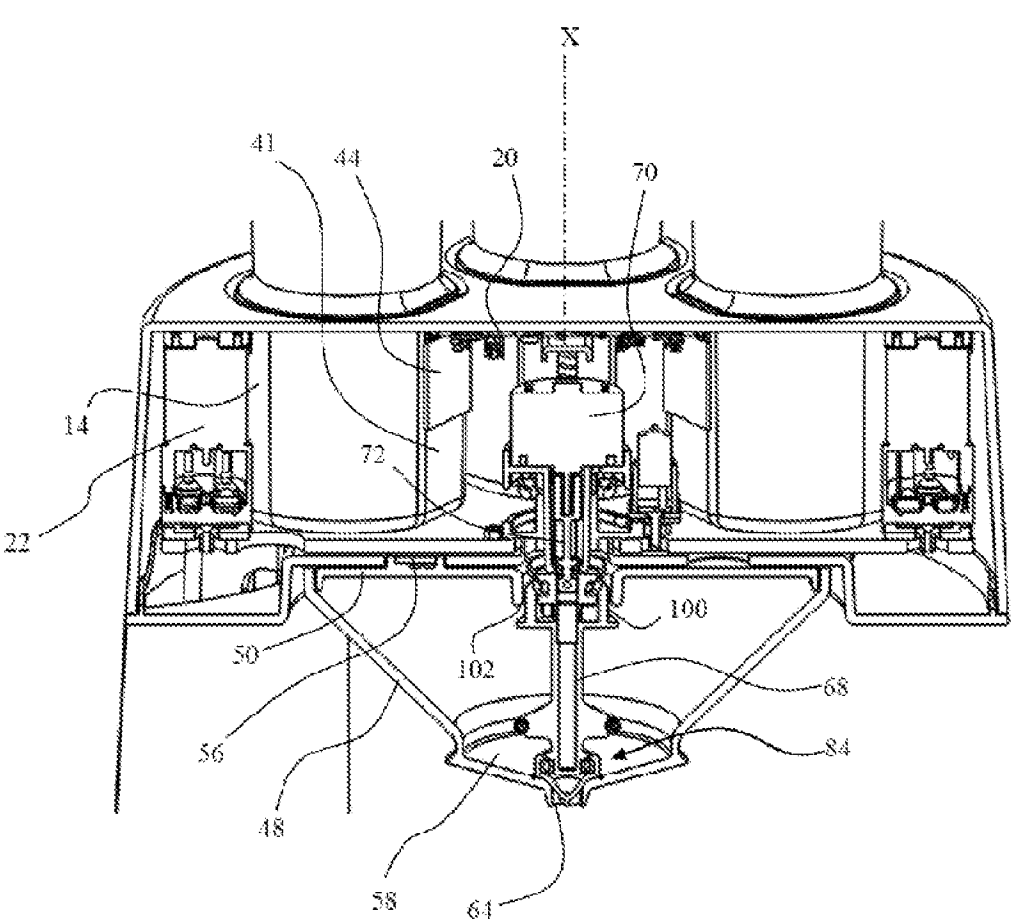
FIG. 2 (2*a* and 2*b*) represents transverse cross-sections of this appliance.
FIG. 2*c* represents, in perspective, the bowl of the funnel and an emulsifier shaft in the closed position.
FIG. 2*d* represents, in longitudinal cross-section, the funnel and the emulsifier shaft in the closed position.
Figure 2A:
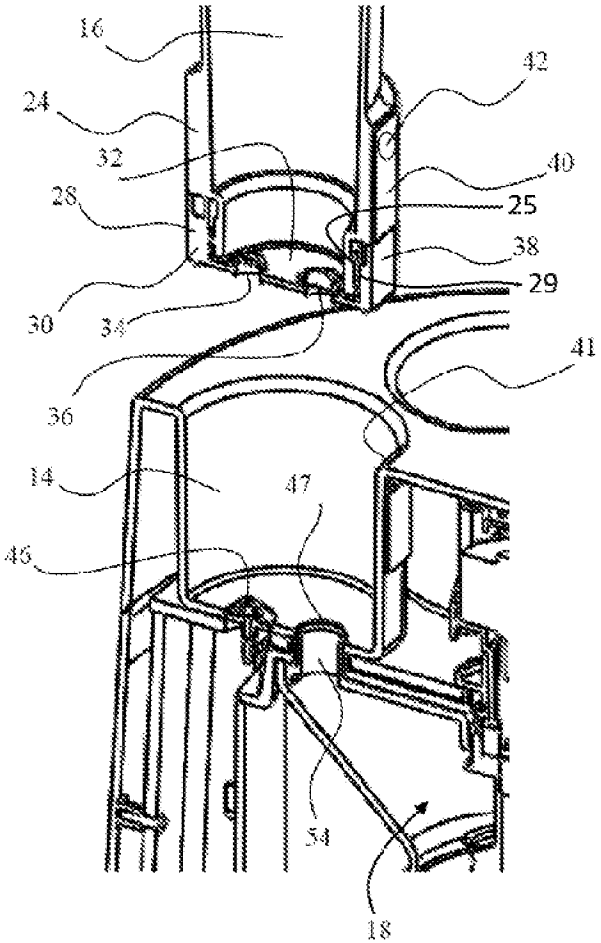
Figure 2D:
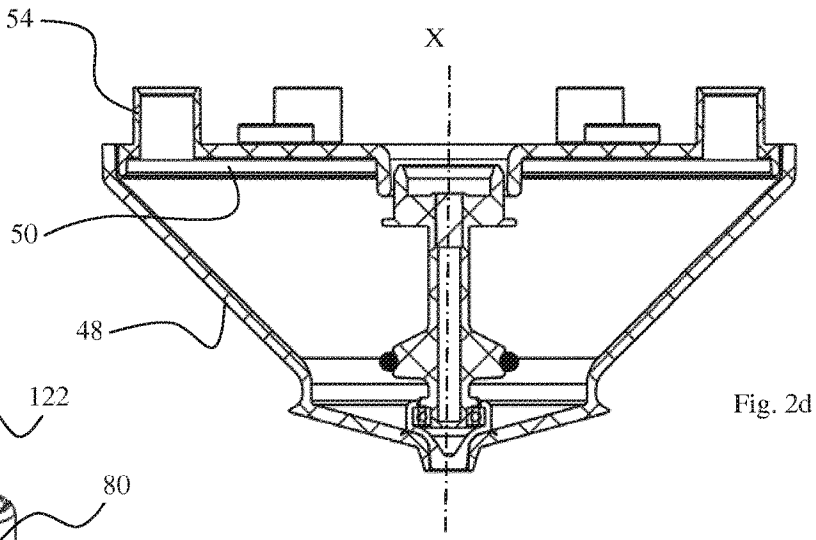

Each container 16 comprises a vessel 24, preferably made of glass, defining a volume in which an ingredient is disposed, and a head 28 that is fixed, preferably screwed, onto the vessel 24 (FIG. 2*a*).

A vessel 24 preferably has an internal volume greater than 0.1 liter, preferably greater than 0.2 liter, and/or less than 1.5 liters, preferably less than 1 liter, preferably approximately 0.5 liter.

The wall of a vessel 24 can be made of any "food-compatible" material suited to the ingredient contained in the vessel. Its thickness is preferably greater than 1 mm, 2 mm or 3 mm.

The head 28 comprises a lateral wall 30, of generally cylindrical form, provided with an internal thread 29 for fixing to an external thread 25 of a neck of the vessel, and a bottom 32 which is passed through by pressurizing 34 and drain 36 valves, fixed to the bottom 32, for example by gluing or clipping.

The fixing threads are preferably configured to ensure a maximum screwing of at least one turn, preferably less than a half turn. Preferably, in the maximum screwing position, a flat 38 of the head, defined by the outer surface of the lateral wall 30, extends in the extension of a flat 40 defined by the outer surface of the vessel 24.

The flats 38 and 40 are head and vessel polarizing surfaces which must be disposed in a predefined position for the container to be able to be housed in its housing. In this predefined position, these flats form a polarizing surface of the container and ensure, in cooperation with a flat 41 of the housing, forming a polarizing surface of the housing, a means for foolproofing the user when he or she inserts the container into its housing.

Advantageously, the head and vessel polarizing surfaces cooperate together and with the polarizing surface of the housing to assure the user that the head is fixed onto the vessel in a predetermined fixing position and that the container is housed in the housing with a predetermined positioning. This cooperation is particularly advantageous when the container is of cylindrical form.

The predetermined fixing position can correspond to a seal-tight fixing position, preferably of maximum screwing, of the head on the vessel. In this case, the cooperation between the different polarizing surfaces makes it possible to assure the user that the fixing of the head on the vessel is seal-tight. Thus, the risk of leaking of the ingredient contained in the vessel is greatly limited.

This cooperation also prevents any unscrewing of the head after the container has been disposed in its housing.

Each container 16 also bears a "tag" 42, preferably of NFC type. The tag 42 is preferably fixed onto the flat 40 of the vessel or onto the flat 38 of the head. Preferably, it extends vertically when the container is disposed in its housing.

The tag 42 preferably contains information on the ingredient contained in the container, for example on its composition, its volume, its density, its origin, the number of calories that it provides or its expiry date.

The appliance comprises a reader provided with an antenna 44, disposed so as to read, without contact, preferably by NFC ("near field communication"), the tag 42.

Preferably, the reader is also capable of writing on the tag 42. Preferably, it is capable of writing, on the tag 42, information relating to the use of the container 16, for example relating to the quantity of ingredient already taken from the container, or to the date of the first use of the container.

The reader is preferably in communication with the control module 20. Advantageously, the control module 20 can inform the user of the need to change a container or provide the next replacement of the container, but also to inform on the expiry of the ingredient contained in the container.

The storage of information on the tag 42 by the reader also makes it possible, advantageously, to retain a traceability of this information, even if the container is taken from its housing, for example to be used on another appliance. The health risks are thereby considerably reduced and the quality of the information supplied to the users is thereby enhanced.

Finally, the tag advantageously allows the control module 20 to know the content and the housing occupied by the container, without the user of the appliance needing to configure it to that end.

Funnel Filling Circuit

The circuit that allows the funnel to be filled with an ingredient initially contained in a container is similar regardless of the container considered. Hereinafter in the description, just one of these circuits is therefore described.

Each housing 14 comprises a pressurizing inlet 46 connected, by a duct that is not represented, to the outlet of a respective pressurizing pump 22.

Each housing 14 also comprises a housing outlet 47 through which the ingredient taken from the container 16 enters into the funnel 18.

The pressurizing pump 22 is configured to pressurize, via the pressurizing inlet 46 of the housing and the pressurizing valve 34 of the head, the interior of each container 16.

The funnel is removable so as to be able to be cleaned.

The funnel 18 comprises a bowl 48 in which the ingredients leaving the housing outlets 47 of the housings are poured, by pressurizing in the vessels 24, and a cover 50 (FIG. 2*b*).

Figure 2C:
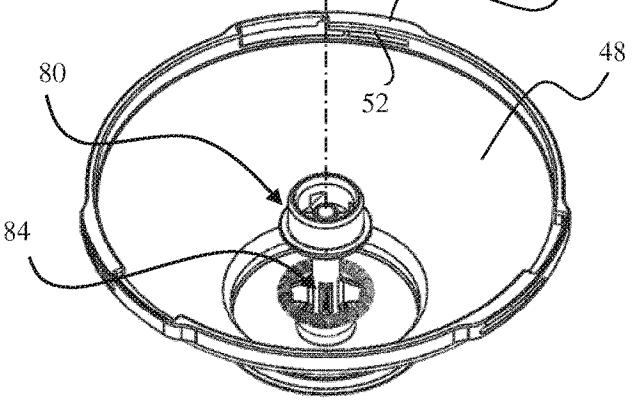

Preferably, the cover 50, preferably of disk form, comprises peripheral lugs, not represented, which come to be housed in corresponding grooves 52 of the bowl 48 (FIG. 2*c*). Once the funnel 18 is separated from the base, the cover 50 can thus easily be disassembled from the bowl 48.

The cover 50 comprises pillars 54 which, in the assembled position of the funnel on the base, are inserted in respective outlets of the housing 47 (FIG. 2*a*) so as to tightly fluidically connect the interior of the bowl 48 and the interior of the vessel 24, via the drain valve 36.

The insertion of the pillars 54 into the housing outlets 47 prevents any rotation of the cover 50 about its axis.

The cover 50 comprises magnets 56 cooperating with metal inserts of the base, which are not represented. This cooperation keeps the funnel 18 pressed against the base in the assembled position.

The bowl 48 comprises a substantially conical lateral wall, of vertical axis, and a bottom 58.

The bowl 48 also comprises runners, in the form of peripheral protuberances 60, which, in the assembled position of the funnel, are housed in respective rails 62, preferably substantially vertical, formed in the base, which prevents the rotation of the bowl 48 about the axis X. A separation of the funnel 18 from the base is not therefore possible by rotation about the axis X.

The number and the positioning of the magnets 56 and of the metal inserts are preferably determined so that, when the funnel is assembled on the base, under the effect of the magnetic attraction, the funnel adopts an angular position about the axis X in which the peripheral protuberances 60 of the bowl 48 are in line with the corresponding rails 62. The assembly of the funnel 18 on the base is thereby facilitated.

In a preferred embodiment, the bowl 48 is disposed immediately under the housing outlets 47. Preferably, each housing outlet 47 emerges, in the downstream direction, directly in the funnel, such that an ingredient leaving through the drain valve 36 of a container drops directly into the bowl 48, without passing through a duct such as a flexible or rigid pipe. The hygiene conditions are then optimal.

The bottom 58 of the funnel 18 is passed through by an outlet orifice 64 that can be selectively closed by means of a shutter described hereinbelow, whose displacement is controlled by the control module 20.

The outlet orifice 64 emerges above the platform 2 for receiving a glass to be filled. The outlet orifice 64 thus allows a flow by gravity of the mixture contained in the funnel, to the glass.

Emulsifier

The appliance also comprises an emulsifier 66 that makes it possible to create an emulsion from the mixture of ingredients contained in the bowl 48.

The emulsifier comprises an emulsifier shaft 68, of axis X, and a drive motor 70 comprising a drive shaft 72 coupled in rotation with the emulsifier shaft 68 about the axis X.

The emulsifier shaft 68 is provided with an emulsion member which can be, as in the embodiment represented, composed of a helical spring 76 closed on itself and encircling the emulsifier shaft 68 by bearing on paddles 78 extending substantially radially with respect to the axis X and preferably equi-angularly distributed about the axis X.

In the embodiment represented, the emulsifier shaft 68 comprises a top end 80 coupled in rotation with the drive shaft 72, via a claw 82, and a bottom end 84 to which the internal ring 86 of a rolling bearing, preferably a ball bearing, is fixed.

In the preferred embodiment represented, the emulsifier shaft 68 is mounted to be movable by translation along the axis X between open and closed positions, so as to selectively close the outlet orifice 64 at the bottom of the bowl 48, and thus serve as shutter. The external ring 88 of the ball bearing constitutes, in the closed position, a bearing guiding the rotation of the drive shaft 68 about the axis X.

Figure 4C:
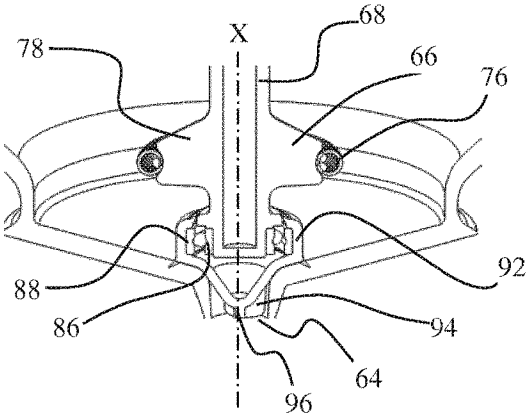
FIG. 4*c* represents a cross-section of the appliance, illustrating the closed position.
Figure 4B:
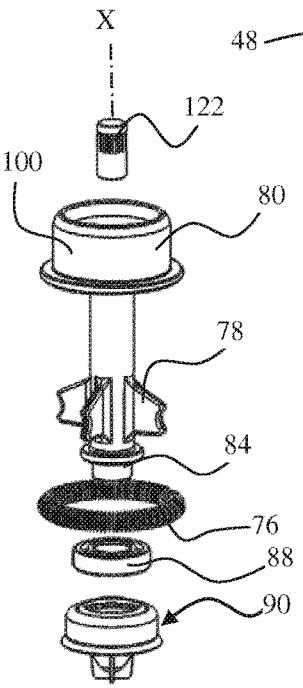
FIG. 4*b* represents an exploded view of the emulsifier shaft.
Figure 4A:
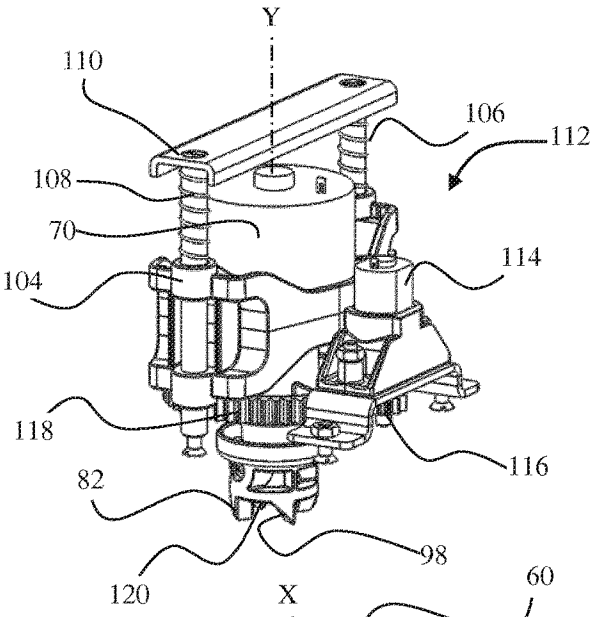
FIG. 4*a* represents, in perspective, the drive motor of the emulsifier shaft and the actuator that makes it possible to modify its position in the vertical direction.

Preferably, a closing plug 90, preferably made of an elastomer, is fixed to the external ring 88 and designed so as to tightly close the outlet orifice 64 of the bowl in the closed position, as represented in FIG. 4*c*.

The closing plug 90 preferably bears a flexible skirt 92 in which the external ring 88 is housed. The dimensions of the skirt 92 are determined in such a way that it elastically compresses the external ring 88, in order to be rigidly secured thereto.

The closing plug 90 also comprises a pilot point 94 extending the skirt 92 downward and designed so as to penetrate into the outlet orifice 64 of the bowl 48, which makes it possible to effectively hold the emulsifier shaft in position with respect to the bowl 48 when the funnel is disassembled from the base.

Also preferably, the pilot point 94 comprises fins 96, extending preferably substantially radially with respect to the axis X and preferably distributed substantially equi-angularly about the axis X.

The number of fins 96 is preferably greater than 2, preferably greater than 3 and preferably less than 8, preferably less than 6. The presence of fins 96 facilitates the insertion of the pilot point 94 into the outlet orifice 64 of the bowl 48. Moreover, in the open position, the fins 96 advantageously guide the flow of the mixture of ingredients contained in the bowl 48, avoiding the appearance of eddies.

To connect together the bottom end of the drive shaft and the top end 80 of the emulsifier shaft 68, these ends comprise respective teeth that mesh in one another. When the funnel 18 is disassembled from the plate, by downward translation, along the axis X, the meshing is eliminated without the operator having to perform any specific operation.

Preferably, the teeth of the bottom end of the drive shaft and/or the teeth of the top end of the emulsifier shaft each have an inclined face 98 facilitating the coupling regardless of the initial angular position of the drive shaft or of the emulsifier shaft.

In a preferred embodiment, the top end 80 of the emulsifier shaft 68 comprises a rigid top skirt 100 which, when the cover 50 closes the bowl 48 (FIG. 2*b*), is housed in an opening 102, of complementary form, formed at the center of the cover. When the funnel is disassembled from the base, the emulsifier shaft 68 advantageously remains held in position, along the axis of the funnel, which makes it possible to keep it in the closed position, at least as long as the funnel is not turned over. Advantageously, if the funnel still contains liquid, this liquid is not therefore poured back in the handling of the funnel.

For the emulsifier shaft 68 to be able to pass between the closed position in which it closes, tightly, the outlet orifice 64 and the open position in which it is cleared from this outlet orifice and allows the flow of the mixture contained in the bowl 48, the emulsifier shaft 68 is movable in translation, along the axis X. To this end, the drive motor 70 is fixed in a support 104 slidingly mounted on two vertical rods 106. A helical spring 108 is threaded onto each rod 106 and compressed between the support 104 and an abutment 110 at the top end of the rod 106, so as to elastically push the support 104 downward.

The translational driving of the support 104 upward is ensured by means of an actuator 112. The actuator motor 112 comprises an actuator motor 114, a first toothed wheel 116 fixed onto the shaft of the actuator motor, and a second toothed wheel 118, driven by the first toothed wheel 116 about the axis of rotation Y of the shaft of the drive motor 70, coinciding with the axis X.

The second toothed wheel 118 comprises a cam follower which presses on an inclined cam surface of the support 104 so that its rotation modifies the altitude of the drive motor 70. Obviously, the invention is not limited to these means for modifying the altitude of the drive motor 70.

Moreover, the top end of the emulsifier shaft 68 is fixed to the bottom end of the drive shaft by magnetic fixing means. The vertical displacement of the drive motor therefore causes that of the emulsifier shaft 68, and thus provokes the opening or the closing of the outlet orifice 64.

In particular, the magnetic fixing means can comprise a magnet 120 fixed onto the bottom end of the drive shaft cooperating with a magnet 122 fixed onto the top end of the emulsifier shaft 68.

Control Module

The control module 20 conventionally comprises an electronic circuit board 124 (FIG. 3) to which there are notably fixed a processor and a memory comprising code instructions making it possible to operate the processor, in particular to control the electrical members, and notably the motors ensuring the operation of the pressurizing pumps and the drive and emulsifier motors.

Each antenna 44, borne by a substrate 126, is connected electrically to the electronic circuit board 124 via conductive tracks on a flexible hinge 128, preferably made of a polymer film. As represented in FIGS. 3*a* and 3*b*, the antennas 44 can thus be separated from the general plane of the electronic circuit board 124, and in particular extend substantially at right angles to the electronic circuit board 124.

Figure 3C:
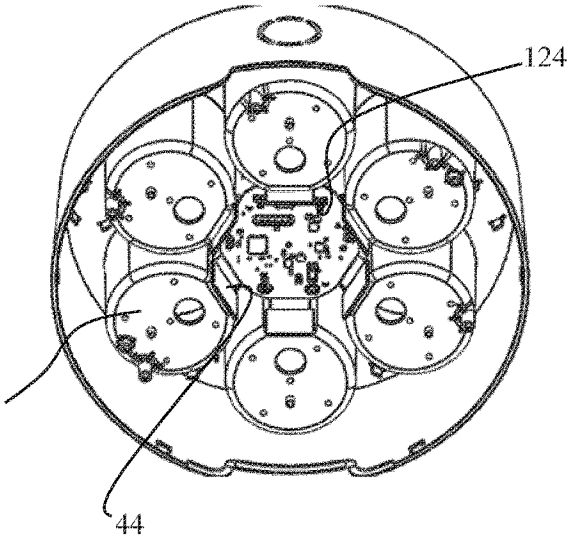
FIG. 3 (3*a*-3*c*) illustrates the assembly of the control module of the appliance represented in FIG. 1.
Figure 3B:
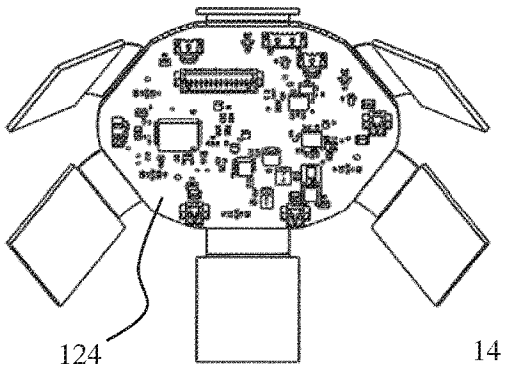
Figure 3A:
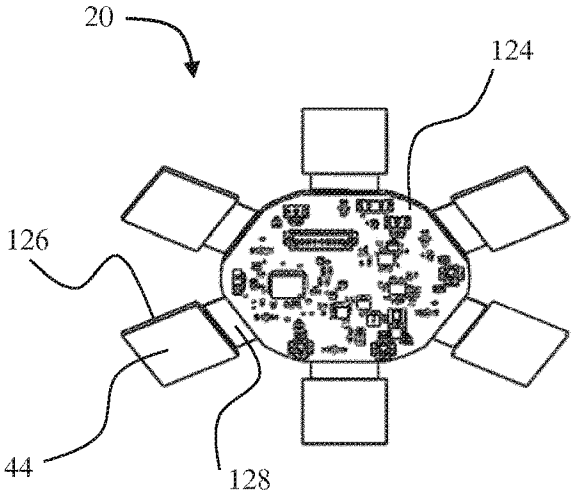

As represented in FIG. 3*c*, the electronic circuit board 124 is preferably disposed between the housings 14, preferably substantially at right angles to the axis X, each substrate 126 extending by bearing on a housing 14 (see also FIG. 2*b*). The compactness of the appliance is enhanced thereby.

In the preferred embodiment, the substrate of an antenna 44 associated with a housing extends against the flat 41 of this housing 14.

Operation

In the preferred embodiment, the appliance operates as follows.

Initially, the funnel is in disassembled position, as represented in FIG. 1*b*. The emulsifier shaft rests, by its bottom end, in the outlet orifice of the funnel and its top end passes through the central opening of the cover, which holds the emulsifier shaft along the axis of the funnel.

The cover is fixed to the bowl by a rotation about its axis, the lugs at the periphery of the cover being inserted into the grooves 52 of the bowl.

The user offers up the funnel to the base in order to introduce the pillars 54 of the cover into the corresponding housing outlets. When the pillars are in proximity to the housing outlets, the magnets fixed to the cover are attracted by the metal inserts of the base, which makes it possible to accurately position the pillars 54 in line with the housing outlets 47, without any specific operation on the part of the user. In this position, the protuberances 60 at the periphery of the bowl 48 are in line with rails 62. After the penetration of the peripheral protuberances 60 into the rails 62, the funnel is guided in translation along its axis to the assembled position in which the cover is held bearing against the base by the cooperation of the magnets of the cover and of the metal inserts of the base.

The rails 62 and the housing outlets 47, cooperating with the protuberances 60 and the pillars 54, respectively, prohibit any rotation of the funnel.

Figure 1A:
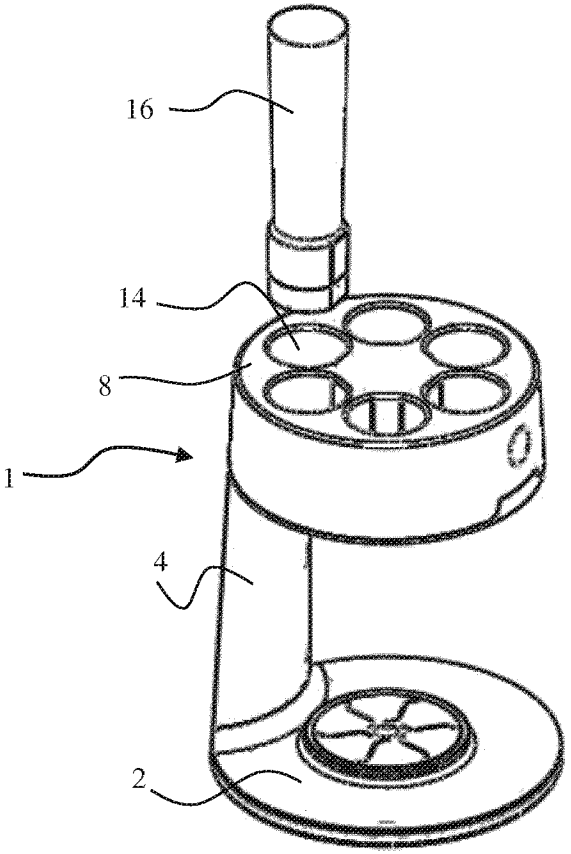

To use the appliance, the user must also introduce the containers 16, by their heads, into the housings 14, as represented in FIG. 1*a*.

The containers can be delivered ready for use, the head of a container being already mounted on the vessel. Preferably, a membrane seal, preferably tight, covers the pressurizing and drain valves. Hygiene is thereby enhanced.

Previously, the head of the container is tightened onto the vessel 24, which makes it possible to align the flats 38 and 40 of the head and of the vessel. These flats then serve as polarizer, by defining a single position allowing the introduction of the container into its housing.

The introduction of the container into its housing makes it possible to couple its pressurizing valve 34 with the pressurizing inlet 46 of the housing, on the one hand, and the drain valve 36 with the housing outlet 47.

The coupling of a container in a housing thus causes a seal-tight circuit to be established from the vessel 24, through the drain valve 36 and the outlet orifice, to the bowl 48 of the funnel.

The tag 42 fixed to the flat 40 of the vessel is then in proximity to the antenna 44, in a position allowing exchanges with the antenna 44. These exchanges allow the control module 20 to know that the container is present in the housing, but also, for example, to know the nature of the ingredient, the remaining quantity of ingredient, and the date it was put into service.

The knowledge of the nature of the ingredient and the remaining quantity of ingredient in the vessel advantageously allows the container to be placed in any housing. Before beginning to make a drink, it is in fact sufficient for the reader to read the tag to know the ingredients that it has available, and their locations and their quantities.

When a container is introduced into its housing, the two flats 38 and 40 face and, preferably, are in contact with the flat 41 of the housing. Neither the vessel 24 nor the head of the container can then turn, which notably prevents any accidental unscrewing of the head.

When a user asks for a drink to be made, the control module orders the closing of the outlet orifice of the funnel. More specifically, it commands the support of the drive motor, and therefore the emulsifier shaft, to be lowered, under the effect of the springs 108, to the closed position.

To transfer an ingredient from its container 16 to the funnel, the control module 20 then activates the pressurizing pump 22 of the associated housing, which makes it possible to inject air under pressure, via the pressurizing valve 34, into the vessel 24. The pressure inside the vessel 24 increases accordingly. Beyond a threshold, under the effect of this pressurization, the drain valve 36 opens and the ingredient can flow, through the drain valve 36 and the outlet of the housing, into the funnel.

The different ingredients can be poured into the funnel simultaneously or not. Preferably, they are poured substantially simultaneously, which speeds up the making of the drink.

The nature of the ingredients and their dosage are determined by means of a recipe stored in the control module 20. Notably to make a cocktail, at least two different ingredients are poured into the funnel. The poured quantity of an ingredient can notably be adjusted with the time of pressurization of the corresponding vessel and/or with the value of the pressure imposed in the vessel.

After dosing a determined quantity of ingredient, according to the recipe, the control module deactivates the pressurizing pump. The drain valve closes.

The control module activates the emulsifier.

In the closed position, the closing plug is pressed against the outlet orifice of the funnel and is thus immobilized. The emulsifier shaft is therefore held laterally by the external ring of the rolling bearing, blocked in position by the closing plug.

Once the mixture is emulsified, the control module 20 commands the opening of the outlet orifice. More specifically, it commands the activation of the actuator motor in order to raise, against the springs 108, the support of the drive motor, and therefore, by virtue of the magnetic coupling between the drive shaft and the emulsifier shaft, raise the closing plug.

The mixture contained in the funnel flows into the glass. The fins 96 guide the flow.

The dose of an ingredient taken from a container is stored, by the reader 44, in the tag 42 of the container. On reading the information contained in the tag, the reader can therefore determine the remaining quantity of ingredient, and, if appropriate, alert the user.

To clean the appliance, the user pulls on the funnel, along the axis X, against the magnetic attraction between the cover and the base on the one hand and between the emulsifier shaft 68 and the drive shaft on the other hand. The assembly composed of the bowl 48, the cover 50 and the emulsifier shaft 68 is then detached from the base. The emulsifier shaft 68 does however remain aligned with the axis of the funnel, being held, in the top part, by the central opening 102 of the cover, and, in the bottom part, by the introduction of the pilot point of the closing plug into the outlet orifice of the funnel. The handling of this assembly is thereby facilitated.

After the removal of the cover, the emulsifier shaft 68 can be removed as can the bowl. The cover and the emulsifier shaft can thus be cleaned separately.

It is noteworthy that the pillars 54 extend, in the assembled position of the funnel, to the housing outlets 47, until they come into tight contact with the respective drain valves 36. Simply cleaning the funnel is thus sufficient to maintain optimal hygiene conditions.

As now clearly emerges, an appliance according to the invention is compact and robust. It makes it possible to very rapidly and accurately make a drink, and in particular a cocktail. Furthermore, the containers can easily be replaced, which offers great versatility of use.

An appliance according to the invention also allows for optimal hygiene, notably because the circuits for the ingredients are extremely short, an ingredient being able to be transferred directly from a container to the funnel, then directly from the funnel to the glass, without passing through pipes.

Preferably, an appliance according to the invention comprises no duct, and in particular no pipe, flexible or rigid, between any container and the funnel.

Obviously, the invention is not limited to the embodiments described and represented, which are provided purely for illustration purposes.

In particular, the polarizing surfaces are not limited to flats. All the surfaces making it possible to hold a container in a relative position with respect to the housing in which it is inserted can be envisaged.

The invention claimed is:

1. An appliance for making a drink individually, said appliance comprising:

a plurality of containers, each container comprising a vessel containing an ingredient of said drink, and a head that is removably fixed to said vessel, said head comprising a pressurizing valve;

a drain valve;

a base comprising a storage rack defining a plurality of housings, each housing receiving one said respective container, and being provided with a housing outlet and a pressurizing inlet connected with the drain valve and the pressurizing valve of said container, respectively;

a funnel mounted under the housing outlets, and comprising an outlet orifice;

means for transferring by pressurization, into the funnel and through the drain valves and the housing outlets of said housings, ingredients contained in the containers housed in said housings;

the vessel and the head of at least one container comprising polarizing surfaces of the vessel and of the head, respectively, configured to form, together, in a position of fixing of the head on the vessel that is predetermined, a container polarizing surface that can cooperate with a housing polarizing surface to ensure a predetermined positioning of the container with respect to the housing, the container polarizing surface cooperating with the head polarizing surface to lock the head in position on the vessel.

2. The appliance as claimed in claim 1, wherein the head is screwed onto the vessel and the predetermined position is a maximum screwing position.

3. The appliance as claimed in claim 1, wherein the container and housing polarizing surfaces extend vertically.

4. The appliance as claimed in claim 1, wherein the container and housing polarizing surfaces extend against one another and are separated from one another by a distance less than 3 mm.

5. The appliance as claimed in claim 1, wherein the vessel and head polarizing surfaces are flat surfaces which, together, define a flat container polarizing surface.

6. The appliance as claimed in claim 5, wherein the housing polarizing surface is a flat surface against which each of said flat surfaces of the vessel and of the head extends, at least partially, when the container is housed in a respective housing.

7. The appliance as claimed in claim 1, wherein the container is provided with a suitable tag for a remote electromagnetic communication and fixed onto the head of said container.

8. The appliance as claimed in claim 7, wherein the tag extends over one of said polarizing surfaces of the vessel and of the head.

9. The appliance as claimed in claim 1, wherein the head has, externally, a cylindrical surface of circular section, locally broken by a flat forming said head polarizing surface.

10. The appliance as claimed in claim 1, wherein the vessel has, externally, a cylindrical surface of circular section, locally broken by a flat forming said vessel polarizing surface.

11. The appliance as claimed in claim 1, wherein the head and vessel polarizing surfaces are configured so that the container can be housed in a respective housing, so as to couple the pressurizing valve with the pressurizing inlet of the housing, on the one hand, and the drain valve with the housing outlet of the housing, only when said polarizing surfaces are disposed in a predefined position.

12. The appliance as claimed in claim 1, wherein each housing is of a form complementing part of the container which is housed therein.

13. The appliance as claimed in claim 1, wherein the head comprises a lateral wall, of cylindrical form, provided with an internal thread for fixing to an external thread of a neck of the vessel.

14. The appliance as claimed in claim 1, wherein the head is designed to be mounted on the vessel by sliding.

15. The appliance as claimed in claim 14, wherein the sliding is in a direction parallel to the axis of the head.

16. The appliance as claimed in claim 14, wherein the head is designed to be mounted on the vessel by clipping after the sliding.

17. The appliance as claimed in claim 16, wherein the clipping is an irreversible clipping.

* * * * *